US012780380B2

(12) United States Patent
Franta

(10) Patent No.: US 12,780,380 B2
(45) Date of Patent: Nov. 3, 2026

(54) FITTING AND METHOD FOR SECURING ANTI-TORSION ROPE

(71) Applicant: John E. Franta, Grover Beach, CA (US)

(72) Inventor: John E. Franta, Grover Beach, CA (US)

( * ) Notice: Subject to any disclaimer, the term of this patent is extended or adjusted under 35 U.S.C. 154(b) by 386 days.

(21) Appl. No.: 18/404,171

(22) Filed: Jan. 4, 2024

(65) Prior Publication Data

US 2025/0223021 A1 Jul. 10, 2025

(51) Int. Cl.
*B63H 9/10* (2006.01)

(52) U.S. Cl.
CPC ..... *B63H 9/1028* (2013.01)

(58) Field of Classification Search
CPC ..... B63H 9/1028
See application file for complete search history.

(56) References Cited

U.S. PATENT DOCUMENTS

| | | | | |
|---|---|---|---|---|
| 2,311,043 A * | 2/1943 | Furey | F16G 11/06 | 403/127 |
| 3,964,419 A * | 6/1976 | Uecker | B63H 9/1028 | 114/106 |
| 9,750,308 B2 * | 9/2017 | Seader | A43C 1/06 | |
| 2015/0210372 A1 * | 7/2015 | Hartlmeier | D07B 1/0673 | 114/105 |

OTHER PUBLICATIONS

Gsproducts, suppliers of chain, wire rope and marine fittings: https://www.gsproducts.co.uk/diy-swage-less-body-jaw/ ; archived on the Wayback Machine as early as Aug. 11, 2020 (Year: 2020).*
Gsproducts Diy Swageless Steel Threaded Wire Rope Fork Terminals (Year: 2020).*

* cited by examiner

*Primary Examiner* — Anthony D Wiest
(74) *Attorney, Agent, or Firm* — TMB Law; Timothy M. Brown

(57) ABSTRACT

The invention provides a fitting for securing anti-torsion rope without requiring the wrapping of the rope around the fitting or the assembly of separate components, such as clamps and line terminators. The invention provides a customizable, readily available system for securing anti-torsion rope and avoids the need for purchasing anti-torsion ropes with pre-manufactured connections.

18 Claims, 6 Drawing Sheets

FITTING AND METHOD FOR SECURING ANTI-TORSION ROPE

FIELD OF THE INVENTION

The invention is in the field of fittings for rope. More particularly, the invention relates to fittings for securing anti-torsion rope in sailing and other applications.

BACKGROUND

Anti-torsion rope is a form of rope that resists twisting so as to transmit torque forces from one end of the rope to the other. Such ropes typically include a core made of aramid or Dyneema®. In sailing applications, anti-torsion rope finds use as stays in furling systems. These systems include a furler drum connected to a bottom end of the anti-torsion rope stay, a swivel connected to the top end of the anti-torsion rope stay and to a mast, and a sail connected to the stay. Turning the furler drum transmits rotation of the drum from the bottom of the anti-torsion rope stay to the top of the stay and swivel thereby coiling the sail around the stay. Thus, the connections to the anti-torsion rope stay are instrumental to the function of the furler system.

FIG. 1 shows a known connection 100 that is in use with anti-torsion rope stays in furling systems. Such connections typically include line terminator 101 around which anti-torsion rope 102 is wrapped. Anti-torsion rope 102 doubles back upon itself and is secured by clamp 103 by a series of screws. Such connections are difficult to install as line terminator 101, anti-torsion rope 102 and clamp 103 present themselves as separate components that must be held in a specific orientation during installation. In addition, clamp 103 typically comprises a pair of opposing parts which must be installed sufficiently close to line terminator 101 in order for line terminator 101 to remain in the anti-torsion rope loop. These challenges are exacerbated by the fact that anti-torsion rope is very stiff and difficult to manipulate.

Alternatively, users acquire anti-torsion rope stays as a pre-manufactured unit. Such a stay 200 is depicted in FIG. 2, wherein anti-torsion rope 201 is wrapped around thimble 202 and secured with manufactured connection 203 which is typically a form of lashing. This form of stay suffers from the fact that its length cannot be modified and must be purchased in a pre-determined length. In addition, these pre-manufactured stays cannot be put together on as as-need basis in a remote location, such as during a sail.

What is needed in the art therefore is an anti-torsion rope fitting that is easy to install, capable of being used with custom rope lengths, and is readily available for use on an as-needed basis.

SUMMARY OF THE INVENTION

The invention provides a fitting for securing anti-torsion rope that is easy to install and need not be sourced from a manufacturer in a predetermined length in an assembled, pre-manufactured state. The inventive fitting avoids the need for wrapping anti-torsion rope around the fitting end and avoids the use of separate components.

The inventive fitting accomplishes its utility, in part, by providing a cavity that receives the end portion of anti-torsion rope which is secured within the fitting by screws which penetrate the rope through the sides of the fitting. The penetration of the rope by the screws creates a mechanical connection between the rope and the fitting. The penetration of the rope by the screws also presses the rope against the sides of the cavity and causes the rope to expand within the cavity to create friction between the rope and the surface of the cavity thereby further securing the rope within the fitting.

The inventive fitting is easy to install as a user need only insert anti-torsion rope within the cavity and tighten the screws. Thus, the complicated wrapping and assembly of separate components required by known anti-torsion rope fittings, such as depicted in FIG. 1, are avoided by the inventive fitting. The inventive fitting also permits a user to secure a desired, customizable length of rope on an as-needed basis since the user need not acquire a predetermined length of rope wherein the rope's end fittings are pre-installed by a manufacturer, such as with the fitting of FIG. 2.

It is an object of the invention to provide a fitting for securing a rope, comprising a body portion having a cavity adapted to receive an end of the rope, a first one or more openings in the body portion, and a second one or more openings in the body portion, wherein the first one or more openings and the second one or more openings are in communication with the cavity, and a first end portion having an opening that is in communication with the cavity.

In some aspects, the fitting comprises a second end portion having a connector.

In some aspects, the fitting comprises a plurality of the first one or more openings and a plurality of the second one or more openings.

In some aspects, the first one or more openings and the second one or more openings are threaded.

In some aspects, the fitting includes two or more screws that are adapted to thread into the first one or more openings and the second one or more openings.

In some aspects, the screws are adapted to enter the cavity when threaded into the first one or more openings and the second one or more openings.

In some aspects, the screws are pointed.

In some aspects, the first one or more openings and the second one or more openings comprise a recession that is countersunk with respect to a surface of the body portion.

In some aspects, (i) the first one or more openings each have a first longitudinal axis, (ii) the second one or more openings each have a second longitudinal axis, and (iii) the first longitudinal axis and the second longitudinal axis are offset from one another.

In some aspects, (i) the first one or more openings each have a first longitudinal axis, (iii) the second one or more openings each have a second longitudinal axis, (iii) the cavity has a third longitudinal axis, and (iv) the first longitudinal axis and the second longitudinal axis are perpendicular to the third longitudinal axis.

In some aspects, the first longitudinal axis and the second longitudinal axis are arranged at an angle to the third longitudinal axis.

In some aspects, the connector comprises an opening.

In some aspects, the connector is adapted to connect to a swivel or furler drum.

In some aspects, the fitting comprises an opening between the connector and the body portion.

In some aspects, the body portion has a cross section that is polygonal, circular, semicircular, oval, or a combination thereof.

It is a further object of the invention to provide a fitting for securing anti-torsion rope for use as a stay in a furling system, comprising a body portion having a cavity adapted to receive an end of anti-torsion rope, a first one or more threaded openings in the body portion opposing a second one or more threaded openings in the body portion, wherein the first one or more threaded openings and the second one or more threaded openings are offset from one another and in communication with the cavity, and a first end portion having an opening that is adapted to connect to a swivel or a furler drum.

DETAILED DESCRIPTION

Figure 1:
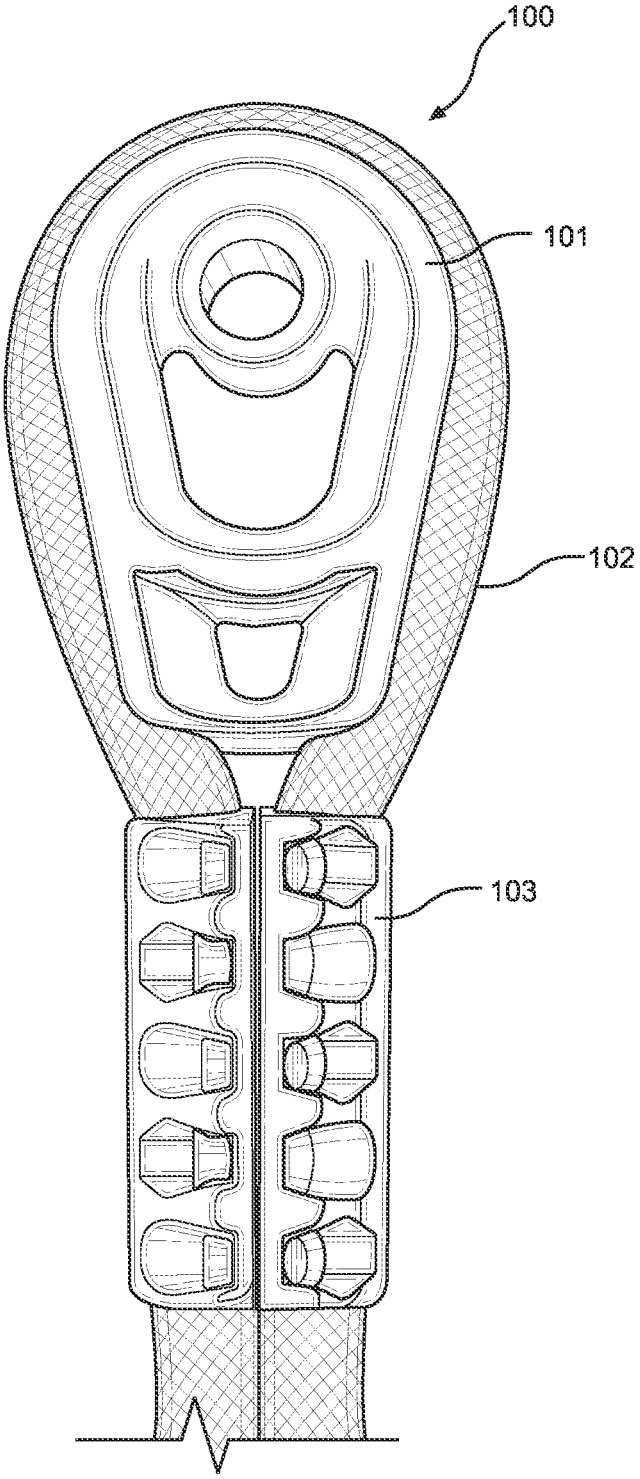
FIG. 1 shows a known fitting for securing anti-torsion rope.
Figure 2:
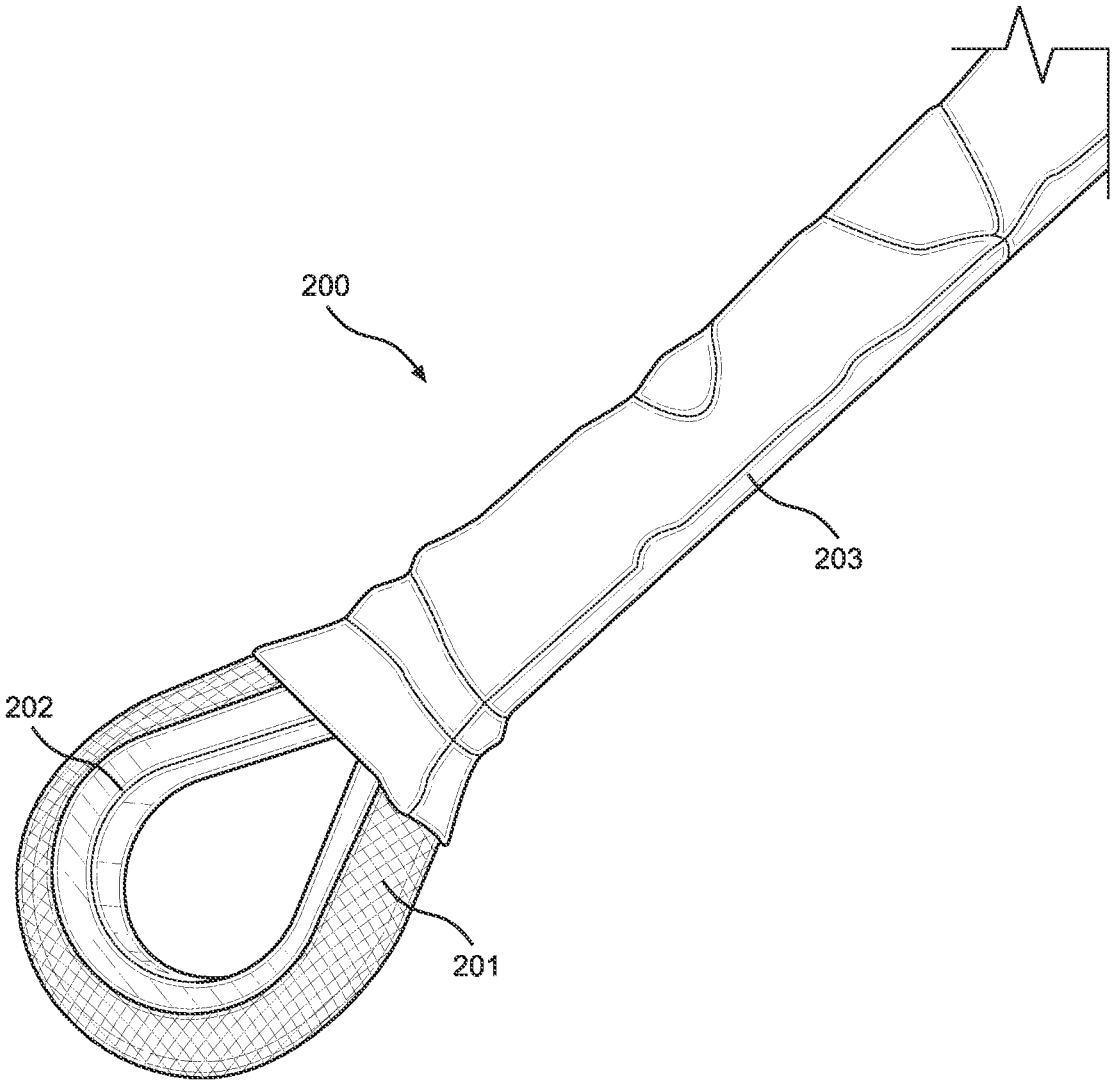
FIG. 2 shows a known, pre-manufactured fitting for securing anti-torsion rope.
Figure 3:
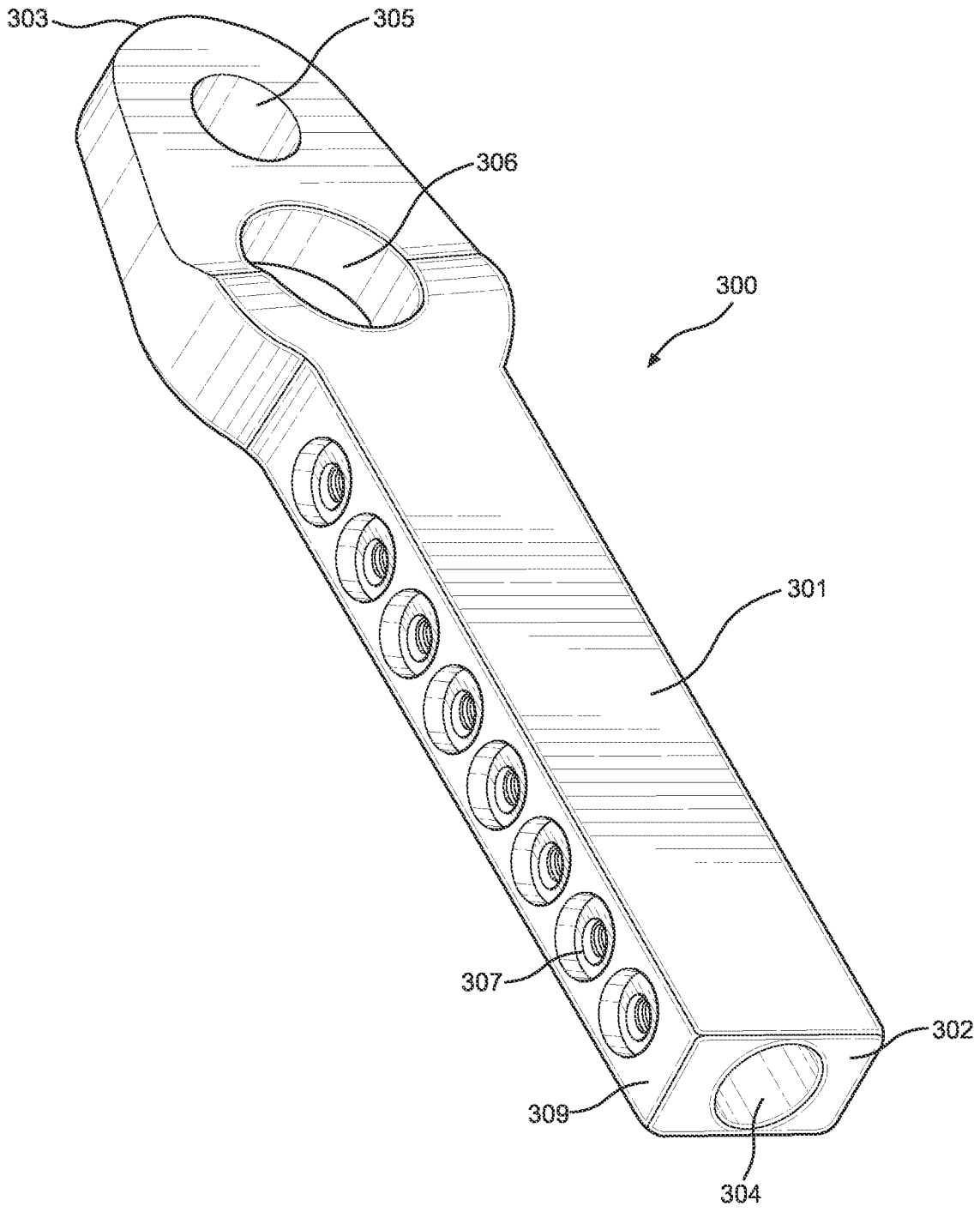
FIG. 3 shows a perspective view of an embodiment of the inventive anti-torsion rope fitting.
Figure 4:
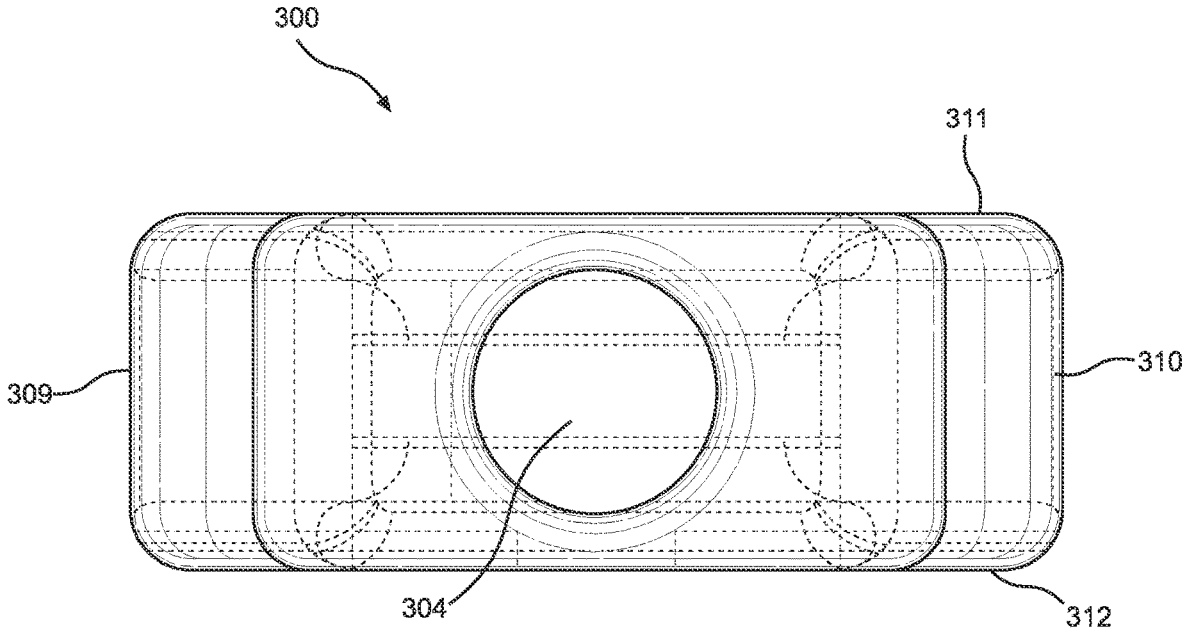
FIG. 4 shows the view of the first end an embodiment of the inventive anti-torsion rope fitting.

FIG. 3 shows an embodiment of the inventive fitting 300 comprising body portion 301 and terminating in first end 302 and second end 303. First end 302 can have a thickness that is the same or greater than the thickness of second end 303. For example, first end 302 can have a thickness that is about 21 mm, while second end 303 has a thickness that is about 12 mm. As used herein, the term "about" means the value or quantity that is referenced, or that varies (plus or minus) up to 5%, up to 10%, up to 15%, or up to 20% of the stated value or quantity.

Body portion 301 can have a cross-sectional shape that is round, oval, semi-circular, polygonal or combinations thereof. In some preferred embodiments, body portion 301 has a cross-sectional shape that is rectangular. First end 302 includes end opening 304 which is adapted to receive an end of an anti-torsion rope for insertion of the rope into cavity 313 in body portion 301. End opening 304 can have a diameter sufficient to receive anti-torsion rope having a diameter that is between about 6 mm and about 19 mm. End opening 304 can have a diameter that is about 6 mm, about 7 mm, about 8 mm, about 9 mm, about 10 mm, about 11 mm, about 12 mm, about 13 mm, about 14 mm, about 15, about 16 mm, about 17 mm, about 18 mm, or about 19 mm. In some aspects, end opening 304 has a diameter that is between about 0.25 mm and about 2.00 mm greater than the diameter of the anti-torsion rope that is inserted into end opening 304. In other aspects, end opening 304 has a diameter that is between about 0.25 mm and about 0.50 mm less than the diameter of the anti-torsion rope that is inserted into end opening 304.

End opening 304 can have a diameter that is: 5.25 mm or up to 5.5 mm; 6.25 mm or up to 6.50 mm; 7.25 mm or up to 7.50 mm; 8.25 mm or up to 8.50 mm; 9.25 mm or up to 9.50 mm; 10.25 mm or up to 10.50 mm; 11.25 mm or up to 11.50 mm; 12.25 mm or up to 12.50 mm; 13.25 mm or up to 13.50 mm; 14.25 mm or up to 14.50 mm; 15.25 mm or up to 15.50 mm; 16.25 mm or up to 16.50 mm; 17.25 mm or up to 17.50 mm; 18.25 mm or up to 18.50 mm; or 19.25 mm or up to 19.50 mm. While end opening 304 is shown as being circular, it will be appreciated that end opening 304 can assume other shapes, such as, for example, an oval or a polygonal shape. End opening 304 can be triangular, square, rectangular, pentagonal, or hexagonal, for example.

The inventive fitting can be made from any material suitable for connecting a rope to a desired fitting, body or surface. The fitting can be made from a metal, metal alloy, or polymer. In some preferred embodiments, the fitting is made from aluminum.

Second end 303 includes a connector that is adapted to permit fitting 300 to be secured to another fitting, body or surface. Second end 303 can be adapted to be secured to a swivel, furler drum, thimble, and/or line terminator, for example. In some non-limiting embodiments, the connector comprises connector opening 305. Connector opening 305 can be adapted to receive a pin to permit the fitting to be connected to a swivel, a furler drum or another fitting, for example. Connector opening 305 can have a diameter that is between about 6 mm and about 25 mm.

The inventive fitting can optionally include opening 306 to permit the fitting to be secured to a rope, wire or fitting, such as for providing a connection to a sail, for example.

Fitting 300 includes a first one or more openings 307 on a side of body portion 301, and a second one or more openings 308 on an opposite side of body portion 301. While openings 307 and 308 are shown in the figures as being located on the lateral sides 309 and 310, it will be appreciated that openings 307 and openings 308 can be located in a similarly opposing fashion on upper surface 311 of body portion 301 and lower surface 312 of body portion 301. That is, openings 307 can be positioned on upper surface 311 and openings 308 can be positioned on lower surface 312. In other embodiments, openings 307 and 308 can be located on adjacent sides of body portion 301. For example, openings 307 can be on lateral side 309, with openings 308 being located on upper surface 311 and/or lower surface 312. Alternatively, openings 307 and 308 can be located on a combination of two or more of lateral side 309, lateral side 310, upper surface 311 and lower surface 312. Openings 307 and 308 are preferably threaded so as to permit the engagement of screws. Openings 307 and 308 can be countersunk such that the heads of screws threaded into the openings can be below, or flush with, the surfaces of body portion 301.

Figure 5:
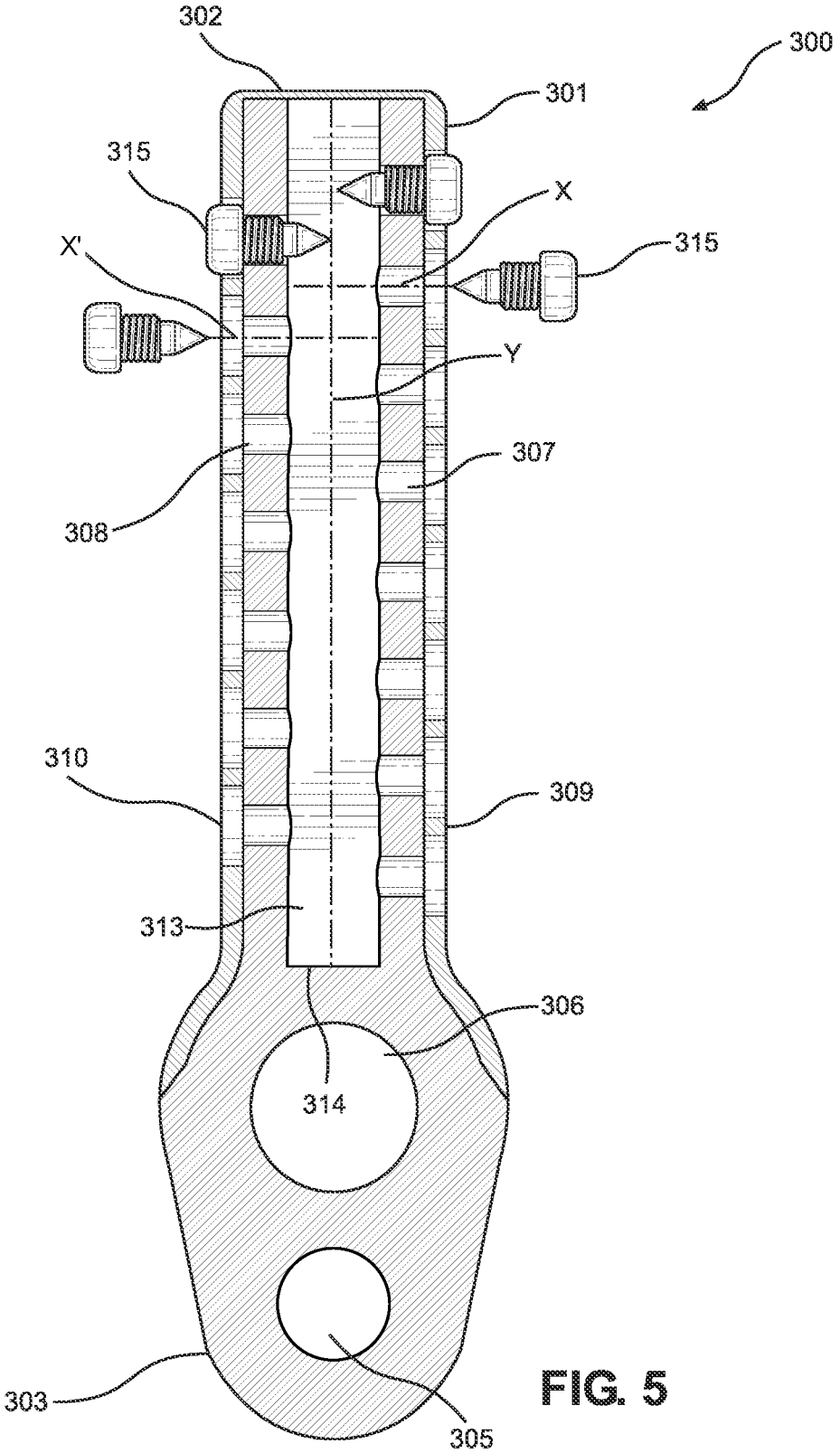
FIG. 5 shows a cross-sectional view of an embodiment of the inventive anti-torsion rope fitting.

FIG. 5 is a cross-sectional view of fitting 300 showing body portion 301 having cavity 313. Cavity 313 forms a void within body portion 301 and is adapted to receive an end portion of an anti-torsion rope. Cavity 313 can traverse a portion of body portion 301 such that cavity 313 terminates at cavity wall 314. Alternatively, cavity 313 can traverse the entirety of body portion 301 such that cavity 313 creates an opening that is in communication with opening 306.

Cavity 313 terminates in, and is in communication with, end opening 304 in first end 302 such that an anti-torsion rope can be fed through end opening 304 and into cavity 313. Cavity 313 can have the same cross-sectional shape and dimensions as end opening 304. Cavity 313 can have a cross-sectional diameter that is between about 6 mm and about 19 mm. Cavity 313 can have a cross-sectional diameter that is about 6 mm, about 7 mm, about 8 mm, about 9 mm, about 10 mm, about 11 mm, about 12 mm, about 13 mm, about 14 mm, about 15, about 16 mm, about 17 mm, about 18 mm, or about 19 mm. In some aspects, cavity 313 has a cross-sectional diameter that is between about 0.25 mm and about 2.00 mm greater than the diameter of the anti-torsion rope that is inserted into end opening 304 and cavity 313. In other aspects, cavity 313 has a cross-sectional diameter that is between about 0.25 mm and about 0.50 mm less than the diameter of the anti-torsion rope that is inserted into end opening 304 and cavity 313.

The cross-section of cavity 313 can have a diameter that is: 5.25 mm or up to 5.50 mm; 6.25 mm or up to 6.50 mm;

7.25 mm or up to 7.50 mm; 8.25 mm or up to 8.50 mm; 9.25 mm or up to 9.50 mm; 10.25 mm or up to 10.50 mm; 11.25 mm or up to 11.50 mm; 12.25 mm or up to 12.50 mm; 13.25 mm or up to 13.50 mm; 14.25 mm or up to 14.50 mm; 15.25 mm or up to 15.50 mm; 16.25 mm or up to 16.50 mm; 17.25 mm or up to 17.50 mm; 18.25 mm or up to 18.50 mm; or 19.25 mm or up to 19.50 mm. Cavity 313 can have a cross-sectional shape that is circular, oval, semi-circular or polygonal. Cavity 313 can have a cross-sectional shape that is triangular, square, rectangular, pentagonal, or hexagonal, for example.

Figure 6:
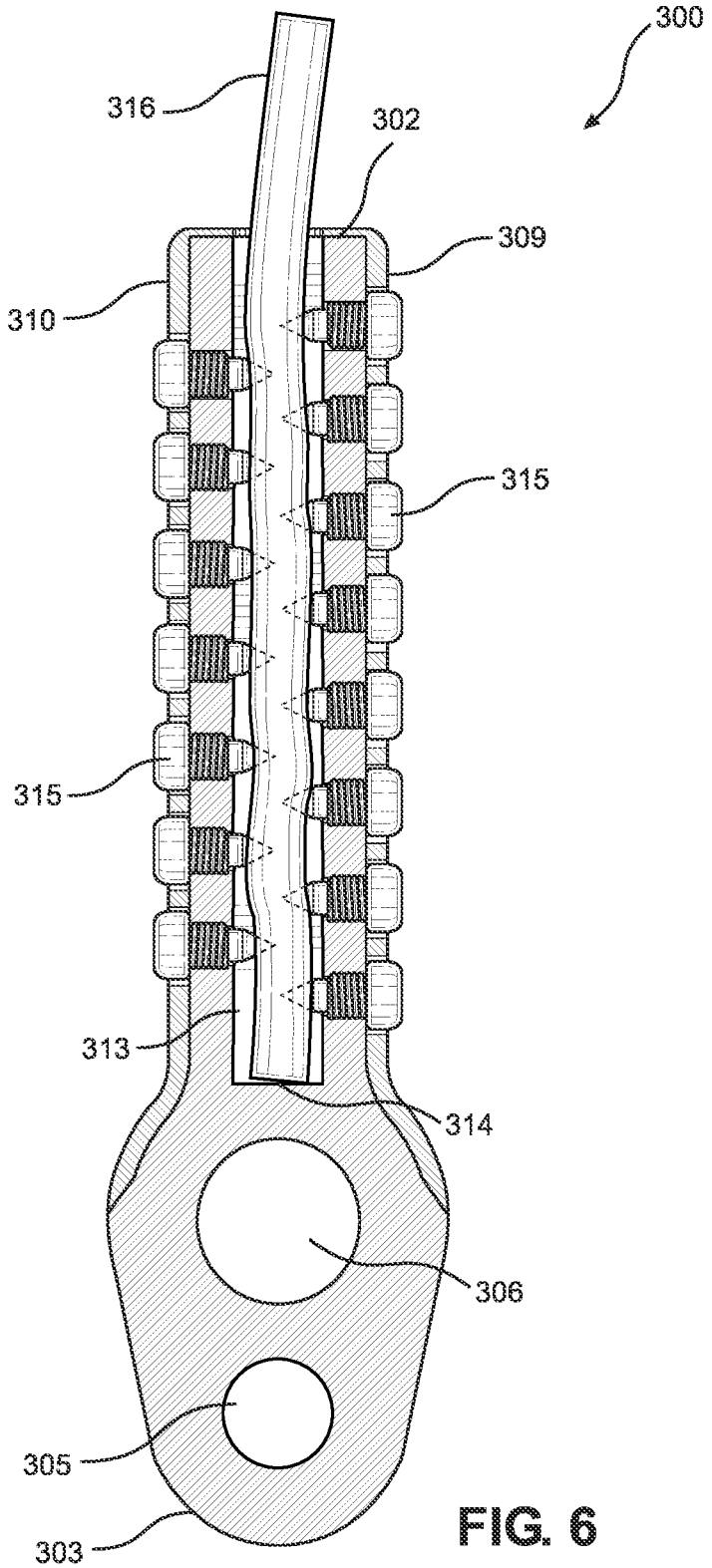
FIG. 6 shows a cross-sectional view of an embodiment of the inventive anti-torsion rope fitting having anti-torsion rope secured therein.

Referring to FIGS. 5 and 6, openings 307 and 308 traverse lateral sides 309 and 310 of body portion 301 such that the openings terminate in, and are in communication with, cavity 313. Openings 307 and 308 are preferably threaded so as to permit screws 315 to be threaded into the openings such that the ends of the screws occupy cavity 313. This permits the ends of screws 315 to penetrate at least a portion of anti-torsion rope 316 in cavity 313.

Openings 307 can have longitudinal axis X and openings 308 have longitudinal axis X'. In some embodiments, openings 307 and 308 are offset from one another on opposing sides of body portion 301 such that openings 307 and 308 are staggered. In some embodiments, openings 307 and 308 are staggered to permit screws 315 to be threaded into body portion 301 without the ends of the opposing screws contacting one another in cavity 315, or without the screws interfering with one another when penetrating anti-torsion rope 316. The staggered configuration of openings 307 and 308 can maximize the expansion of anti-torsion rope 316 within cavity 313 when screws 315 penetrate the rope. The staggered configuration of openings 307 and 308 can cause anti-torsion rope 316 to assume a zig-zag configuration within cavity 313 when screws 315 contact or penetrate the rope, such as shown in FIG. 6. Without wishing to be bound to any particular theory or mechanism, this zig-zag configuration increases (i) the mechanical forces holding the anti-torsion rope within cavity 313, and (ii) the expansion of the anti-torsion rope within cavity 313 so as to increase the friction between the anti-torsion rope and the wall of cavity 313 thereby strengthening the connection between the rope and the fitting.

Cavity 313 can have longitudinal axis Y along its length. While longitudinal axes X and X' of openings 307 and 308 are depicted as being perpendicular to longitudinal axis Y, it will be appreciated that longitudinal axes X and X' can be arranged at an angle with respect to longitudinal axis Y. For example, longitudinal axes X and X' can be arranged at an acute angle with respect to longitudinal axis Y, wherein the opening of the angle faces first end 302, second end 303, or a combination thereof.

In some aspects, the invention provides a method of securing a rope to a surface, body or fitting. Such methods can be practiced by inserting the end of a rope, such as an anti-torsion rope for example, into end opening 304 and feeding the rope into cavity 313. The rope can be fed into cavity 313 until the end of the rope contacts cavity wall 314. With the rope so positioned within cavity 313, screws 315 are threaded into openings 307 and 308 such that the ends of the screws penetrate the rope to provide (i) a mechanical connection between the fitting and the rope, and (ii) expansion of the rope to increase friction between the surface of the rope and the wall of cavity 313 thereby reinforcing the mechanical connection between the rope and the fitting. With the rope so connected to the fitting, the fitting can then be secured to a surface, body or another fitting. For example, the fitting can be connected to a swivel, furler drum or another fitting so as to provide a stay connection for use within a sailing furling system. Alternatively, the fitting can be connected to a surface, body or another fitting, and then secured to a rope as disclosed herein.

While the present description calls out the use of the inventive fitting with anti-torsion rope, it will be appreciated that the fitting can be used with other forms of rope that do not resist torsion, or with wire or cable. It will further be appreciated that the inventive fitting can be practiced with applications other than the use of the fitting in sailing applications. Thus, the inventive fitting can be used in any application where a rope, wire or cable is desired to be secured to a surface, body or another fitting. It will further be appreciated that rope, wire or cable can be secured within cavity 313 using an adhesive or epoxy in addition to, or in place of, screws 315.

In some embodiments, the invention provides a kit for securing anti-torsion rope. The kit can comprise a fitting as disclosed herein, screws as disclosed herein, and anti-torsion rope. The anti-torsion rope can have a diameter that is about 6 mm, about 7 mm, about 8 mm, about 9 mm, about 10 mm, about 11 mm, about 12 mm, about 13 mm, about 14 mm, about 15, about 16 mm, about 17 mm, about 18 mm, about 19 mm, or a combination thereof. The anti-torsion rope can have a diameter that is the same as, greater than, or less than the dimensions of opening 304 and cavity 313 as disclosed herein. The kit can further include at least one of instructions for securing the fitting to anti-torsion rope, and an adhesive and/or epoxy for fixing the anti-torsion rope within cavity 313. The kit can substitute the anti-torsion rope with, or further include, another form of rope, or wire and/or cable.

REFERENCE CHARACTERS FOR THE INVENTIVE FITTING

300—Fitting
301—Body Portion
302—First End
303—Second End
304—End Opening
305—Connector Opening
306—Opening
307—First Openings
308—Second Openings
309—Lateral Side
310—Lateral Side
311—Upper Surface
312—Lower Surface
313—Cavity
314—Cavity Wall
315—Screws
316—Rope

The invention claimed is:

1. A fitting for securing anti-torsion rope and for use as a stay in a furling system, comprising:

a body portion having a cavity having a longitudinal axis, wherein the cavity is adapted to receive a rope;

a first one or more openings in the body portion and a second one or more openings in the body portion, wherein (i) the first one or more openings and the second one or more openings are in communication with the cavity; and (ii) the first one or more openings and the second one or more openings oppose one another along the longitudinal axis; and the body portion including a first end portion having an opening that is in communication with the cavity;

wherein (iii) the body portion is a single continuous body terminating in a second end portion having a first connector opening with a first connector opening axis that is perpendicular to the longitudinal axis of the cavity.

2. The fitting of claim 1, wherein the fitting comprises a plurality of the first one or more openings and a plurality of the second one or more openings.

3. The fitting of claim 2, wherein the plurality of the first openings are staggered across from the plurality of the second openings.

4. The fitting of claim 1, wherein the first one or more openings and the second one or more openings are threaded.

5. The fitting of claim 4, wherein the fitting includes screws that are adapted to thread into the first one or more openings and the second one or more openings.

6. The fitting of claim 5, wherein the screws are adapted to enter the cavity when threaded into the first one or more openings and the second one or more openings.

7. The fitting of claim 5, wherein the screws are pointed.

8. The fitting of claim 1, wherein the first one or more openings and the second one or more openings comprise a recession that is countersunk with respect to a surface of the body portion.

9. The fitting of claim 1, wherein (i) the first one or more openings each have a first longitudinal axis, (ii) the second one or more openings each have a second longitudinal axis, and (iii) the first longitudinal axis and the second longitudinal axis are offset from one another.

10. The fitting of claim 1, wherein (i) the first one or more openings each have a first longitudinal axis, (ii) the second one or more openings each have a second longitudinal axis, and (iii) the first longitudinal axis and the second longitudinal axis are perpendicular to the longitudinal axis of the cavity.

11. The fitting of claim 1, wherein the first connector opening is adapted to connect to a swivel, furler drum or another fitting.

12. The fitting of claim 1, wherein the fitting comprises a second connector opening between the first connector opening and the first one or more openings and the second one or more openings.

13. The fitting of claim 1, wherein the body portion has a cross section that is polygonal, circular, semicircular, oval, or a combination thereof.

14. The fitting of claim 1, wherein the longitudinal axis spans an entire length of the cavity.

15. The fitting of claim 1, wherein (i) the first one or more openings each have a first longitudinal axis, (ii) the second one or more openings each have a second longitudinal axis, and (iii) the first longitudinal axis and the second longitudinal axis are arranged at an acute angle to the longitudinal axis of the cavity.

16. A fitting for securing anti-torsion rope and for use as a stay in a furling system, comprising:

a body portion having a cavity having a longitudinal axis, wherein (i) the cavity is adapted to receive an end of anti-torsion rope, and (ii) the body portion is a single continuous body;

a first one or more openings in the body portion opposing a second one or more openings along the longitudinal axis of the cavity, wherein the first one or more openings and the second one or more openings are offset from one another and in communication with the cavity;

the body portion including a first end portion having an opening that is in communication with the cavity; and the body portion including a second end portion having a connector opening with a connector opening axis, wherein (iii) the connector opening is adapted to connect to a swivel, a furler drum or another fitting, and (iv) the connector opening has an opening axis that is perpendicular to the longitudinal axis of the cavity.

17. The fitting of claim 16, wherein the longitudinal axis spans an entire length of the cavity.

18. The fitting of claim 16, wherein (i) the first one or more openings are a first plurality of threaded openings, (ii) the second one or more openings are a plurality of second threaded openings, and (iii) the plurality of first threaded openings and the plurality of second threaded openings are staggered across from one another.

* * * * *